US008032957B2

(12) United States Patent
Sullivan

(10) Patent No.: US 8,032,957 B2
(45) Date of Patent: Oct. 11, 2011

(54) DRAINAGE TRAY FOR SHAMPOOING BOWLS

(75) Inventor: Kathy M. Sullivan, Cleveland Heights, OH (US)

(73) Assignee: Kathleen M. Sullivan, Cleveland Heights, OH (US)

( * ) Notice: Subject to any disclaimer, the term of this patent is extended or adjusted under 35 U.S.C. 154(b) by 1217 days.

(21) Appl. No.: 11/331,628

(22) Filed: Jan. 13, 2006

(65) Prior Publication Data

US 2006/0174404 A1 Aug. 10, 2006

Related U.S. Application Data

(60) Provisional application No. 60/650,566, filed on Feb. 7, 2005.

(51) Int. Cl.
*A45D 44/08* (2006.01)

(52) U.S. Cl. ..... 4/520; 4/516

(58) Field of Classification Search ..... 4/515–517, 4/520, 641, 642, 523, 519, 521
See application file for complete search history.

(56) References Cited

U.S. PATENT DOCUMENTS

| | | | | |
|---|---|---|---|---|
| 1,617,537 | A | 4/1925 | Morin | |
| 2,451,653 | A | 10/1948 | Bazelon | |
| 2,948,903 | A | 8/1960 | Gilmer | |
| 3,449,771 | A | 6/1969 | Watson | |
| 4,352,216 | A | 10/1982 | Grim | |
| 4,651,361 | A | 3/1987 | Nolan | |
| 4,754,503 | A * | 7/1988 | Martin | 4/517 |
| 4,998,303 | A | 3/1991 | Smithers | |
| D327,957 | S | 7/1992 | Amuzzini | |
| 5,528,776 | A | 6/1996 | Carmichael | |
| 6,931,674 | B1 | 8/2005 | Dean | |

* cited by examiner

*Primary Examiner* — Tuan Nguyen
(74) *Attorney, Agent, or Firm* — Fay Sharpe LLP

(57) ABSTRACT

A drainage tray is adapted to be placed in a hair shampooing bowl having a bottom and front and rear walls extending upwardly from the bottom, a drain opening adjacent the front wall, and a peripheral edge spaced above the bottom and including an area on the front wall for supporting the neck of a person. The tray, when supported on the bottom of a shampooing bowl, is spaced below the peripheral edge and includes a perforated bottom wall having a front end, a rear end and sides between the front and rear ends and a perforated peripheral side wall extending upwardly from the bottom wall about the front and rear ends and the sides thereof. A portion of the peripheral side wall extends below the bottom wall to support the bottom wall of the tray above the bottom of a shampooing bowl.

10 Claims, 4 Drawing Sheets

DRAINAGE TRAY FOR SHAMPOOING BOWLS

CROSS REFERENCE TO RELATED APPLICATIONS

This application claims priority to U.S. Provisional Application Ser. No. 60/650,566 filed Feb. 7, 2005 entitled "Hair Rinse Rack" which is incorporated herein by reference in its entirety.

BACKGROUND OF THE INVENTION

This invention relates to the art of beauty parlor equipment and, more particularly, to a drainage tray for a shampoo bowl to facilitate washing and rinsing of a patron's hair.

It is of course well known that beauty parlors have shampoo bowls over which a patron's head is disposed during shampooing and rinsing of the patron's hair. Most often, the bowl has an arcuate section in a front wall thereof which cradles the patron's neck, and the rear end of the bowl includes water supply valving and a spray head for rinsing shampoo from a patron's hair following washing thereof. The shampoo bowl further includes a drain in the bottom wall thereof towards the rear of the bowl through which rinse water and shampoo drains during a rinsing operation.

It is not unusual for a patron to have shoulder length or even waist length hair, and the shampooing and rinsing thereof is not only difficult but potentially unsanitary to some extent. In this respect, for example, the hair of a patron with shoulder to waist length hair lies on the bottom of the shampoo bowl which makes it difficult for rinse water to penetrate the hair without the beautician having to lift the hair off of the bottom of the shampoo bowl with one hand while trying to rinse the hair with the other hand. Moreover, if the patron's hair is left on the bottom of the shampoo bowl a residue often occurs on the ends of the patron's hair, and the hair is also subject to any contaminants which might be left in the bowl from a previous patron and/or from solutions used by the beautician in connection with washing and rinsing a patron's hair. Still further, if the patron's hair is of waist length or thereabout, it can easily flow into the drain opening which not only can cause clogging of the latter but also adds to the potential unsanitary condition of the hair. Again, to avoid the latter, a beautician must support the patron's hair in one hand and try and rinse it with the other which is time consuming and difficult as well as inefficient.

BRIEF DESCRIPTION OF THE INVENTION

A drainage tray is provided in accordance with the present invention which is removably received in a shampoo bowl and which precludes a patron's hair from either engaging the bottom of the shampoo bowl or entering the drain opening. Further in accordance with the invention, the tray has a perforated bottom wall which is spaced above the bottom of the shampoo bowl, whereby rinse water can freely flow through a patron's hair to maximize the removal of shampoo therefrom. The tray has a peripheral side wall which advantageously confines a patron's hair to the area of the tray during rinsing and, preferably, the tray is configured to be positionally reversed in a shampoo bowl to accommodate hair of both intermediate and long length such as waist length. In this respect, the tray can be positioned so as to extend in the bottom of the shampoo bowl to cover the drain, whereby the hair of a patron with extremely long hair can be accommodated in a manner which optimizes access to the hair for rinsing as well as drainage of water through the tray. In the reverse position of the tray, the same advantages are achieved in connection with rinsing the hair of a patron with medium length hair.

It is accordingly an outstanding object of the present invention to provide an accessory for use in a beauty parlor to assist a beautician in washing and rinsing the hair of a patron which is of medium to long length.

Another object is the provision of an accessory for use in a shampoo bowl which prevents a patron's hair from engaging the bottom of the shampoo bowl and/or entering the drain in the bowl.

Still another object is the provision of an accessory of the foregoing character which improves maintaining sanitary conditions in connection with the washing and rinsing of patron's hair.

Still another object is the provision of an accessory of the foregoing character which improves the efficiency with respect to rinsing shampoo from a patron's hair while optimizes the removal of shampoo from the hair.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DETAILED DESCRIPTION

Figure 1:
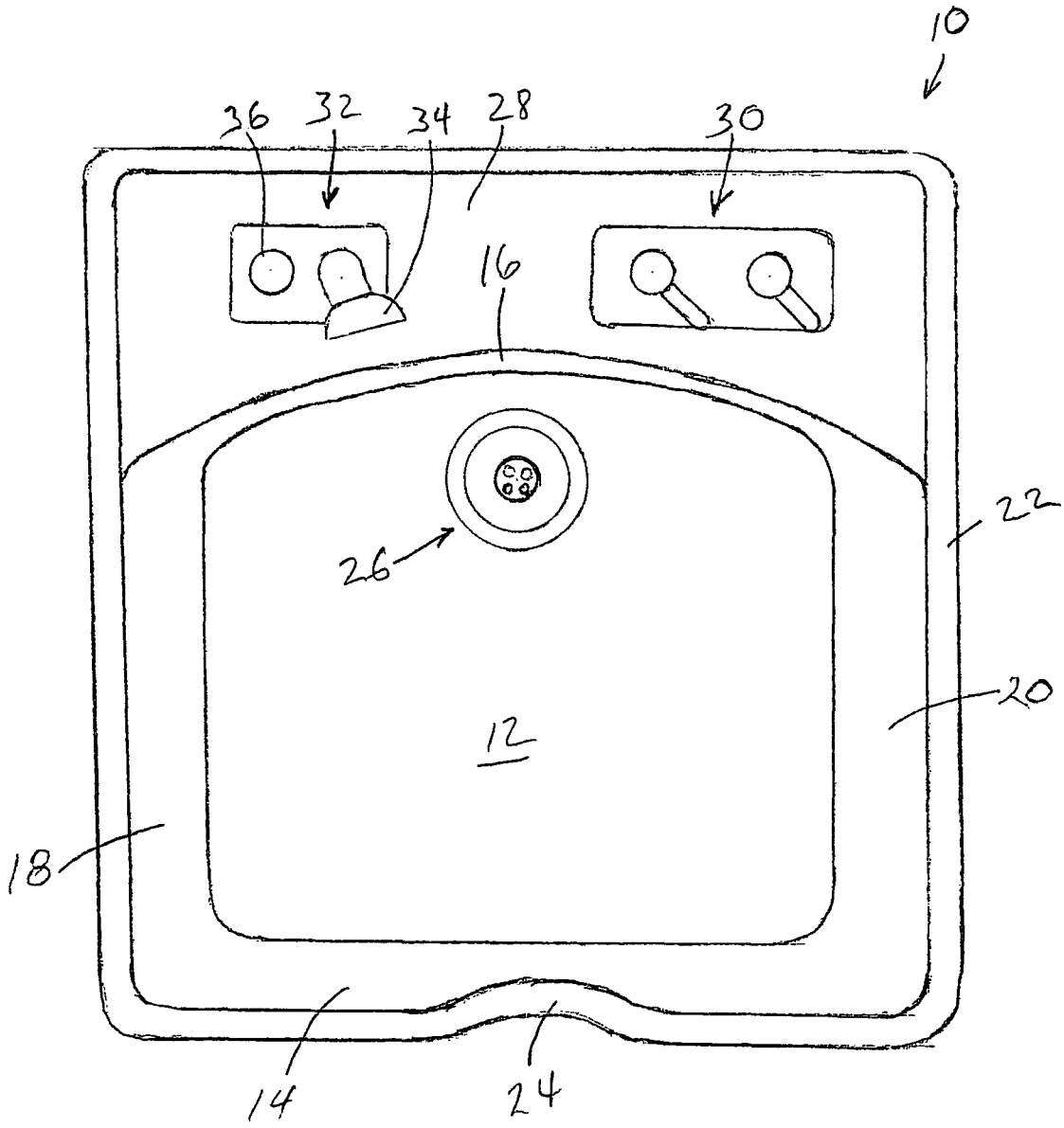
FIG. 1 is a plan view of a shampoo bowl of the character used in beauty parlors.

Referring now in greater detail to the drawings, wherein the showings are for the purpose of illustrating a preferred embodiment of the invention only, and not for the purpose of limiting the invention, FIG. 1 illustrates a typical shampoo bowl 10 having a bottom 12, front and rear walls 14 and 16, respectively, and side walls 18 and 20 extending upwardly from bottom wall 12 and terminating in a peripheral edge 22 which is spaced above bottom wall 12 and includes an arcuate area 24 on front wall 14 for supporting the next of a person who's hair is being washed and rinsed. The bowl further includes a drain 26 in bottom wall 12 and a ledge 28 at the upper ends of the side and rear walls of the bowl and which ledge accommodates a hot and cold water faucet assembly 30 and a spray head assembly 32 which, as is well known, includes a spray head 34 attached to the end of a hose so as to be extendible and retractable relative to the shampoo bowl. The spray head assembly also includes a vacuum breaker 36.

Figure 2:
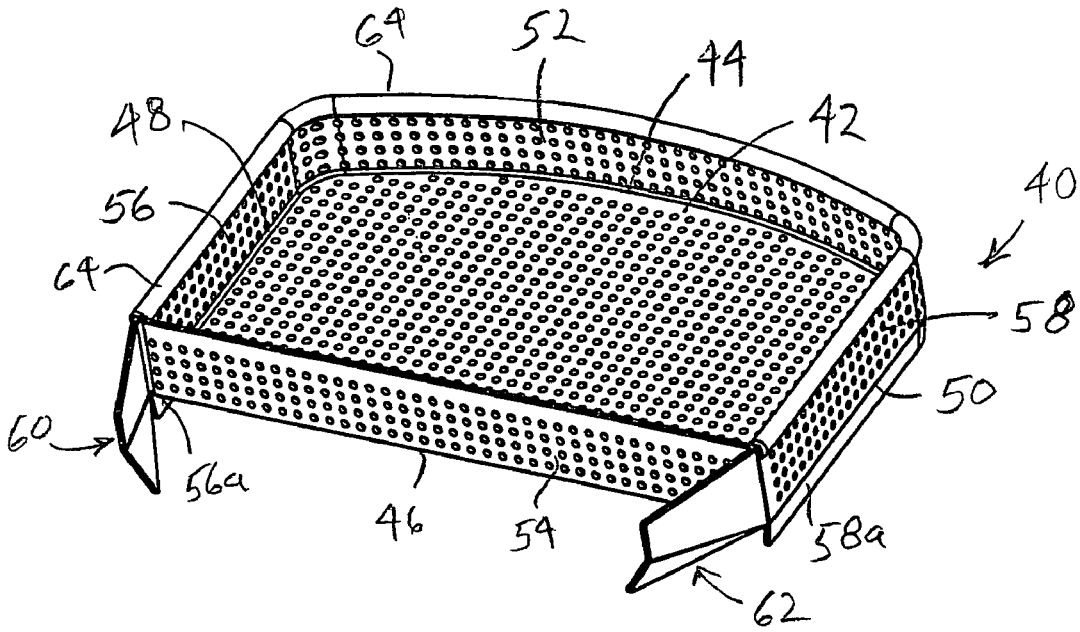
FIG. 2 is a perspective top view of a rinsing tray in accordance with the present invention.
Figure 3:
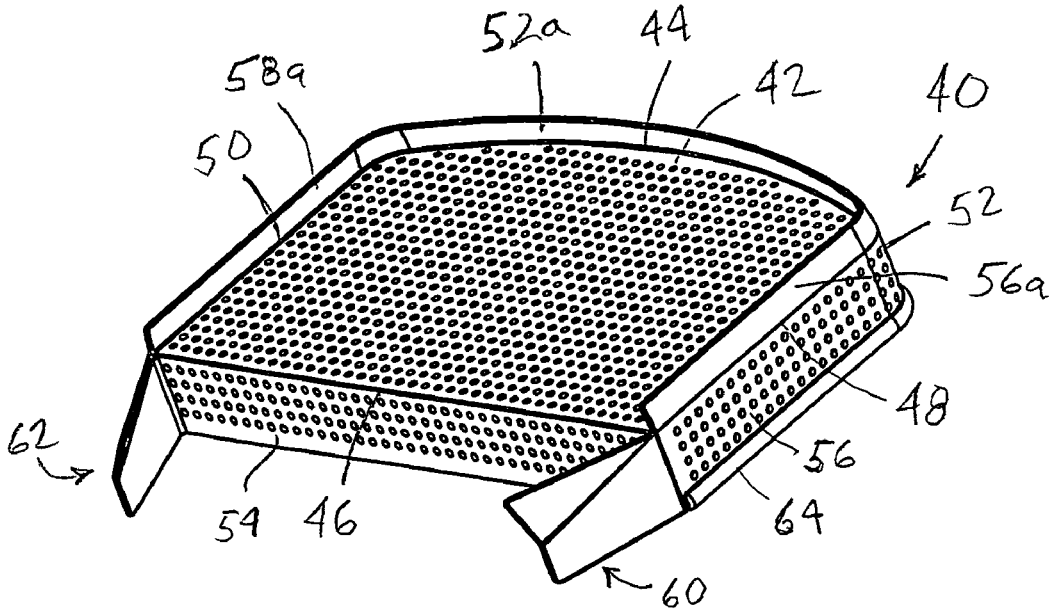
FIG. 3 is a perspective view of the bottom of the tray.

FIGS. 2 and 3 illustrate a drainage tray 40 in accordance with the present invention which is adapted to be removably received in bowl 10 as will become apparent hereinafter. Tray 40 includes a perforated bottom wall 42 having an arcuate front edge 44, a linear rear edge 46, and linear side edges 48 and 50 between the front and rear edges. The tray further includes a peripheral wall extending upwardly from bottom wall 42 and including an arcuate front wall 52 extending along front edge 44 of the bottom wall, a linear rear wall 54 extending along rear edge 46 of the bottom wall, and side walls 56 and 58 extending along side edges 48 and 50 of bottom wall 42, respectively. Preferably, the front, rear and side walls of the tray are also perforated. As best seen in FIG. 3, front wall 52 and side walls 56 and 58 have corresponding lower portions 52*a*, 56*a* and 58*a* which extend downwardly below bottom wall 42 for the purpose which will become apparent hereinafter. Side walls 56 and 58 intersect with rear wall 54 to provide corners therebetween, not designated numerically, and tabs 60 and 62 extend rearwardly from the corners and laterally inwardly toward one another for the purpose which will become apparent hereinafter. Preferably, the upper edges of at least front wall 52 and side walls 56 and 58 are provided with protective tubing 64 of plastic or the like to protect the hair of a patron whose hair is being shampooed and rinsed.

Figure 4:
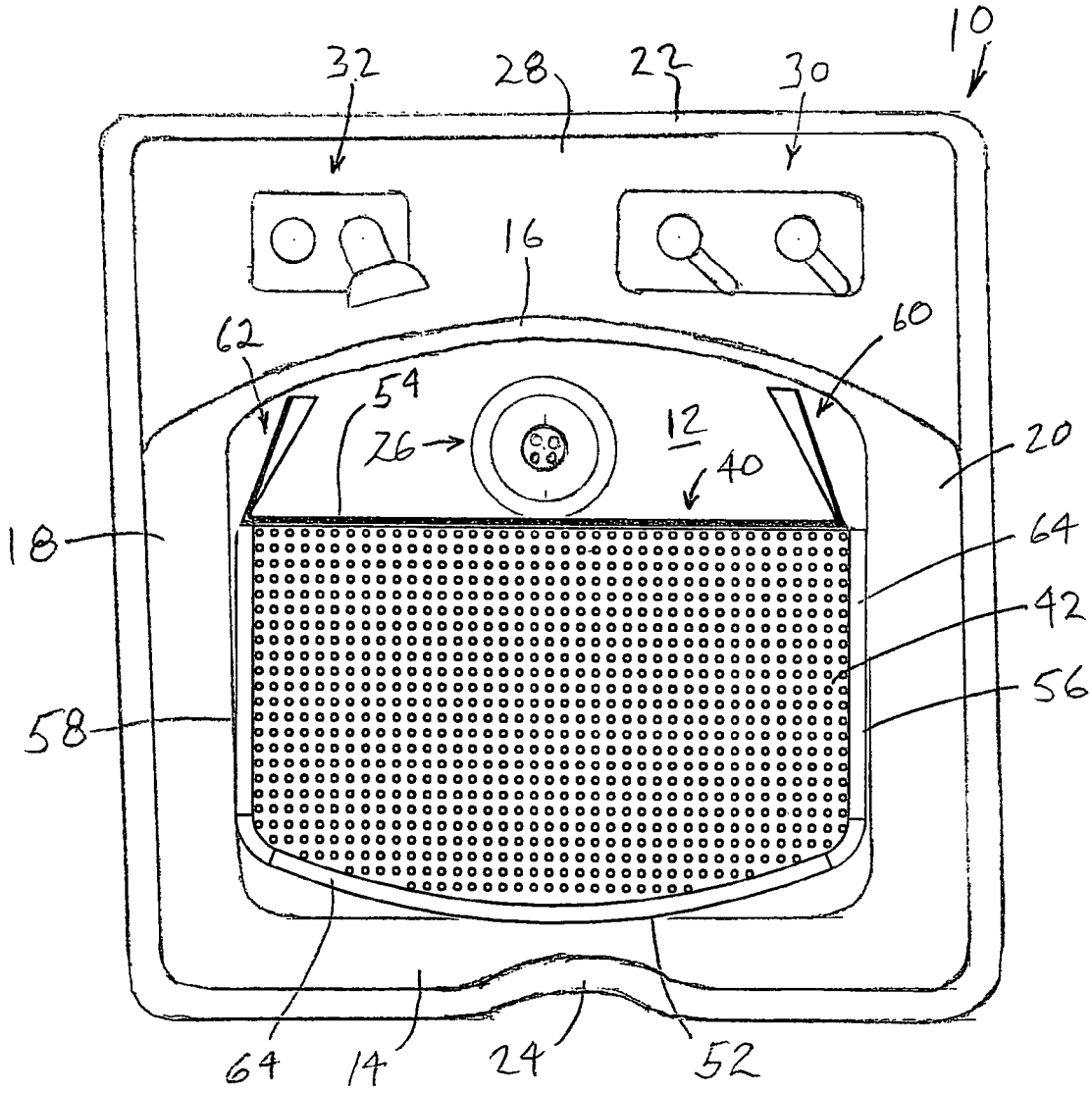
FIG. 4 is a plan view showing the tray in the shampoo bowl of FIG. 1 in a first position for rinsing short to medium length hair; and, FIG. 5 is a plan view of the tray in a second position in the shampoo bowl for rinsing long hair.
Figure 5:
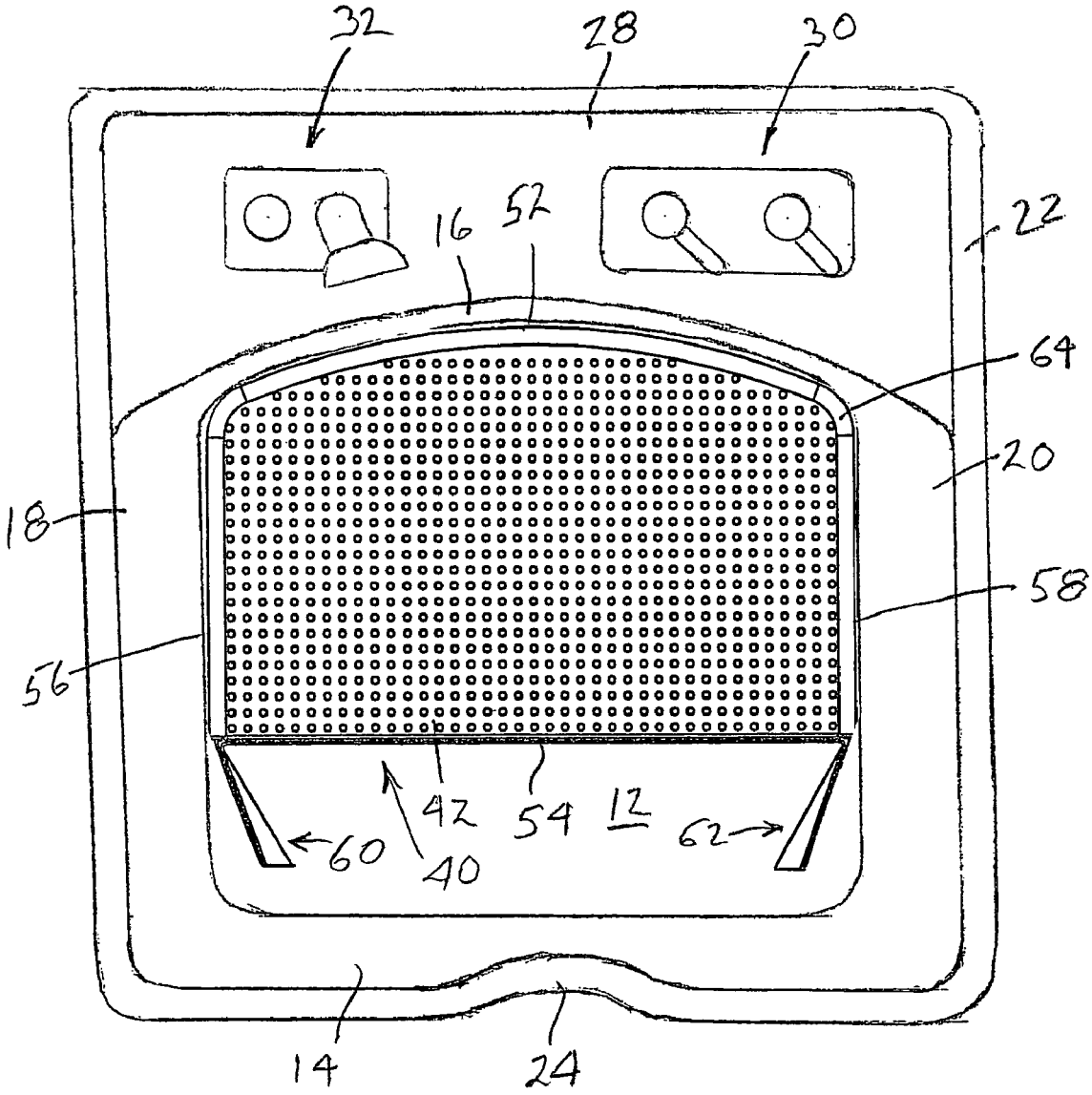

FIGS. 4 and 5 of the drawing illustrate alternate positions of tray 40 in a shampoo bowl such as that shown in FIG. 1 and which positions advantageously facilitate a beautician's rinsing patron's hair of a length which, without the tray, would engage bottom 12 of the bowl. In FIG. 4, tray 40 is positioned in the bowl on bottom 12 for front wall 52 to be adjacent front wall 14 of the bowl, for side walls 56 and 58 to respectively be adjacent side walls 20 and 18 of the bowl and for tabs 60 and 62 to be positioned to engage rear wall 16 of the bowl so as to maintain the tray against any extensive displacement relative to the bowl. In this position of tray 40, rear wall 54 of the tray is forwardly of drain 26 and the tray is positioned to receive and confine the hair of a patron which is of medium length. As will be appreciated from FIGS. 2 and 3, bottom wall 42 of the tray is spaced above bottom 12 of bowl 10 whereby a beautician can easily rinse a patron's hair and that the dirty rinse water readily flows through the hair and through the bottom wall of the tray onto the bottom 12 of the bowl and into drain 26 while the patron's hair is maintained within in the confines of the tray. Accordingly, rinsing of the hair is achieved without residue being deposited on the patron's hair and without the hair engaging the bottom of the bowl and possibly entering drain 26. In the position of the tray shown in FIG. 5, front wall 52 of the tray is adjacent front wall 16 of the bowl and, preferably, is of an arcuate contour generally conforming to the contour of wall 16. In this position of tray 40, bottom wall 42 covers drain 26 and, as will be appreciated from the relative positions between portion 24 of bowl wall 14 and rear wall 54 of the tray, the latter is positioned to facilitate a beautician's rinsing of the hair of a patron which is long, such as waist length. Again, it will be appreciated that the bottom, front, side, and rear walls of the tray confine the hair of a patron to the tray while facilitating the flow of rinse water therethrough and to the underlying drain as a result of bottom wall 42 of the tray being above bottom 12 of the bowl.

Tray 40 can be constructed of any suitable material, such as perforated plastic or sheet metal such as aluminum, plastic or metal screen, mesh, or the like. Preferably, the tray is peripherally contoured and dimensioned to substantially conform to the shape of a shampoo bowl with which it is to be used and, in the preferred embodiment, the tray has a height of about two inches (2") and bottom wall 42 of the tray is spaced about one-half inch (½") above bottom 12 of a shampoo bowl. Perforations other than round apertures as shown herein can be used. While it is not necessary, it is preferred to perforate the front, rear and side walls of the tray in that the latter promotes a more rapid flow of rinse water through a patron's hair and out of the tray to the underlying sink bottom and drain to optimize the efficiency of the rinsing operation.

While considerable emphasis has been placed herein on a preferred embodiment of the invention, it will be appreciated that many changes can be made in the preferred embodiment and that other embodiments can be made without departing from the principles of the invention. Accordingly, it is to be distinctly understood that the foregoing descriptive matter is to be interpreted merely as illustrative of the invention and not as a limitation and that it is intended to include other embodiments and all modifications of the preferred embodiments insofar as they come within the scope of the appended claims or the equivalents thereof.

The invention claimed is:

1. A portable drainage tray in combination with a stationary, non-portable hair shampooing bowl, said bowl having a bottom wall and front and rear walls extending upwardly from said bottom wall, a drain opening formed in said bottom wall adjacent said front wall, and a peripheral edge spaced above said bottom wall and including a recess on said front wall for supporting the neck of a person, said tray when removably supported on the bottom wall of said shampooing bowl being spaced below said peripheral edge and positioned above said drain opening in said bowl, wherein said tray comprises a perforated bottom wall having a front end, a rear end and sides between said front and rear ends, a peripheral side wall extending upwardly from said bottom wall about the front and rear ends and the sides thereof, and at least a portion of said peripheral side wall extending below said bottom wall of said tray to support the bottom wall of said tray above the bottom wall of said shampooing bowl; and wherein said tray further comprises a pair of tabs extending rearwardly from corners of said tray and laterally inwardly toward each other for engaging said rear wall of said bowl.

2. A drainage tray according to claim 1, wherein said peripheral side wall is perforated above said bottom wall of said tray.

3. A drainage tray according to claim 1, wherein said peripheral side wall includes a linear rear wall along said rear end of said bottom wall of said tray and an arcuate front wall along said front end of said bottom wall of said tray, said front wall being concave with respect to said rear wall.

4. A drainage tray according to claim 1, wherein the portion of said peripheral side wall extending about the front end and the sides of said bottom wall of said tray extends below said bottom wall of said tray.

5. A drainage tray according to claim 1, wherein said peripheral side wall includes a rear wall along said rear end of said bottom wall of said tray and side walls along the sides of said bottom wall of said tray and intersecting said rear wall to provide said corners therebetween.

6. A drainage tray according to claim 5, wherein said peripheral side wall is perforated above said bottom wall of said tray.

7. A drainage tray according to claim 6, wherein said peripheral side wall includes a linear rear wall along said rear end of said bottom wall of said tray and an arcuate front wall along said front end of said bottom wall of said tray, said front wall being concave with respect to said rear wall.

8. A drainage tray according to claim 7, wherein the portion of said peripheral side wall extending about the front end and the sides of said bottom wall of said tray extends below said bottom wall of said tray.

9. A drainage tray according to claim 8, wherein said side walls along the sides of said bottom wall of said tray are linear between said front wall and said rear wall.

10. A drainage tray according to claim 9, wherein said front wall and said side walls of said tray have upper edges, and a protective cover overlying said upper edges.

* * * * *